United States Patent [19]

Kochevar

[11] 4,452,456

[45] Jun. 5, 1984

[54] ARTICLE WEIGHTING METHOD

[76] Inventor: Rudolph J. Kochevar, 252 Arbolada Dr., Arcadia, Calif. 91006

[21] Appl. No.: 415,747

[22] Filed: Sep. 7, 1982

[51] Int. Cl.[3] ..... A63B 53/02

[52] U.S. Cl. ..... 273/169; 273/80.8; 156/295

[58] Field of Search ..... 273/169, 80.2–80.8, 273/162 R, 170, 171, 63 E; 156/295

[56] References Cited

U.S. PATENT DOCUMENTS 4,220,336 9/1980 Kochevar ..... 273/169 X

*Primary Examiner*—George J. Marlo

*Attorney, Agent, or Firm*—Gordon L. Peterson

[57] ABSTRACT

A weight capsule having rupturable walls and an interior cavity containing a particular substance, such as an adhesive or solvent. The weight capsule may be placed in a cavity of a member and compressively loaded to rupture the wall so that the substance is in intimate contact with the surrounding structure in the cavity of the member. The weight capsule may include a mass of weight composition.

9 Claims, 8 Drawing Figures

ARTICLE WEIGHTING METHOD

BACKGROUND OF THE INVENTION

Various manufacturing, maintenance and repair jobs call for internally weighting a member. For example, in the manufacture of golf clubs, it is necessary to accurately weight each club in order to provide a matched set of golf clubs.

A golf club typically include a head having a tubular section and a tubular shaft. One end of the tubular shaft is received within the tubular section of the head and suitably affixed thereto. With this construction, a cavity is defined by the internal surfaces of the tubular shaft and the tubular section of the head. In order to weight the club, it is conventional practice to place a weight into the end of the tubular shaft remote from the head and allow such weight to travel through the passage in the shaft. The weight is then secured in place at or near the bottom of the passage.

It is known to glue a weight in the cavity of the club by inserting a tube through the hollow shaft from an upper end thereof and injecting adhesive into the hollow shaft prior to or after insertion of the weight. However, in this case, an accurate weight of the adhesive supplied cannot be determined. Additionally, some of the adhesive may stick to the shaft as the tube is withdrawn.

In my U.S. Pat. No. 4,220,336 I have disclosed a method for weighting golf clubs using a weight capsule in the form of a heavy putty-like mass. The weight mass is dropped down the hollow shaft of the golf club and axially compressed by a ram to extrude the material of the weight capsule radially outwardly into any crevices which exist at the bottom of the shaft. This locks the weight mass to the golf club and the weight mass had an adherent quality which tends to cause it to adhere to the inner surfaces of the club. This technique eliminates the prior art gluing process and is quite satisfactory. However, a concern exists that in some applications the weight mass may not adhere due to presence of dust, rust, or other contaminants, and may rattle and cause imbalance of the golf club.

SUMMARY OF THE INVENTION

The present invention provides a method and apparatus which overcome the problems of the prior art.

The present invention provides a weight capsule having a rupturable wall defining a chamber which contains a substance which may be an adhesive, or a solvent. In use, the weight capsule is placed in the cavity of a member which is to be weighted. The weight capsule is then compressively loaded to rupture the rupturable wall and free the substance so that the substance can come into intimate contact with the internal wall of the member. The weight capsule may contain more than one chamber for containing, for example, a two part epoxy adhesive. In the case of a golf club, the weight capsule is dropped down the shaft and an axial compression force is applied by a ram, which ruptures the frangible wall of the weight capsule and frees the substance contained therein into the surrounding structures. In this manner, the particular substance can be delivered to normally inaccessible places.

If the substance is an adhesive, the adhesive cures to adhere the ruptured wall in the cavity. The weight capsule, including the adhesive, can be provided in various different predetermined weights to provide the member with the desired additional amount of weight. The rupturable wall can advantageously take the form of a heavy material, such as lead. For example, lead foil having a thickness of from about 0.002 inch to about 0.04 inch is preferred. Lead foil is heavy, easily deformable and rupturable and, for these reasons, is one preferred material for the rupturable wall; however plastic, other metals or glass can also be used.

To increase the weight of the weight capsule, it may include a mass of deformable weight composition. In this event, compressively loading the weight capsule results in contact between the substance freed from the chamber of the weight capsule and the weight composition. If the substance is an adhesive, it adheres the weight capsule to the internal walls defining the cavity. In addition, compressively loading this form of weight capsule may deform the weight composition into contact with any shoulder present in the cavity to further tend to retain the weight capsule in the cavity.

When the weight capsule comprises the rupturable wall and the weight composition, these two components of the weight capsule can be coupled together or provided separately and separately placed into the cavity. In either event, it is preferred to place the rupturable wall between the weight composition and the end wall or end wall portion of the cavity. This tends to capture the substance in the cavity.

If the substance is a solvent, it may be selected to attack, penetrate or dissolve rust, dirt and other contaminants within the cavity. In this event, a mass of weight composition having an adherent quality may be utilized, and in the absence of rust on the internal wall of the cavity, the weight composition is more likely to be properly retained in position. The solvent may also temporarily soften the mass of weight composition thereby promoting its adhesion to the internal wall of the cavity even in the presence of a light contaminant. After the solvent evaporates a strong bond remains between internal wall and the weight composition.

Alternatively, the solvent-containing weight capsule can be used in conjunction with, or prior to, an adhesive-containing weight capsule. If so used, the solvent may be a primer which prepares the internal wall of the cavity to promote adhesion with the adhesive. Primers are available for many adhesives, and the primer should be selected in accordance with the adhesive manufacturers' recommendations.

In order that the substance can contact the rupturable wall, the internal wall defining the cavity and the weight composition, the substance should be flowable, at least when compressively loaded to bring about rupture of the rupturable wall. In this regard, the substance may be in the form of a liquid or extrudable mass.

To prevent evaporation of the solvent or curing of the adhesive prior to rupture of the rupturable wall, the chamber defined by the rupturable wall should be substantially closed and is preferably sealed. This also shields the walls of the tubular shaft of the golf club from the substance as the weight capsule passes through the shaft enroute to the cavity.

DETAILED DESCRIPTION OF THE PREFERRED EMBODIMENT

Figure 1:
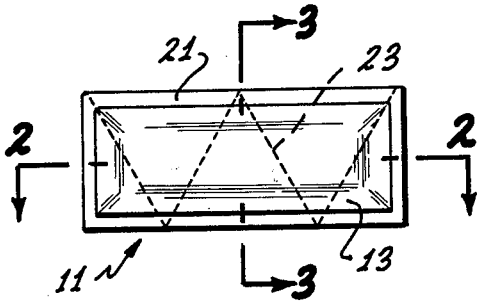
FIG. 1 is the top view of one form of weight capsule of the present invention.
Figure 2:
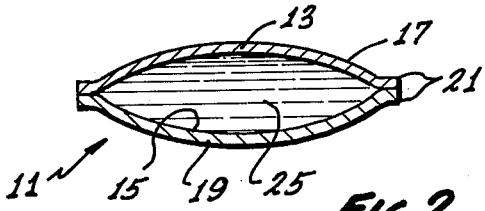
FIG. 2 is a sectional view along lines 2—2 of FIG. 1.
Figure 3:
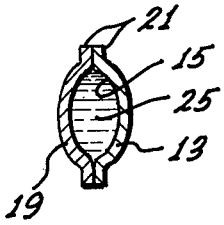
FIG. 3 is a sectional view along lines 3—3 of FIG. 1.

FIGS. 1–3 show a weight capsule 11 having a wall 13 defining a closed interior chamber 15. The wall 13 may be formed of sheets 17 and 19 sealed at their edges 21 to seal the interior cavity 15. The edges 21 may be crimped together, joined by adhesive or heat sealed. The sheets 17 and 19 may be similar or dissimilar material, as thin aluminum, lead or other heavy metal foils. For example, the wall may comprise lead foil having a thickness between 0.002 to 0.04 inches.

The wall 13 is frangible, i.e., ruptures under compressive load. For such purposes scorelines 23 of any suitable configuration may be provided on the wall 13. The scorelines 23 would be particularly useful if the wall 13 is formed of thick sheets.

The interior cavity 15 contains a particular flowable substance 25 which may be selected from the group of adhesives and solvents. For example, the adhesive may be silicone cement or epoxy and the solvent may be selected in accordance with the parameters discussed above.

The total weight of the weight capsule 11 can be precisely determined by knowing the weight of the wall 13 and the weight of the substance 25 that occupies the interior cavity 15. For example if the substance is an adhesive, the adhesive may provide at 50% by volume of the weight capsule. It should be emphasized that although the shape of the weight capsule 11 is shown in FIGS. 1–3 as being substantially rectangular in plan and elliptical in cross section, that is by no means a limitation of the present invention.

Figure 4:
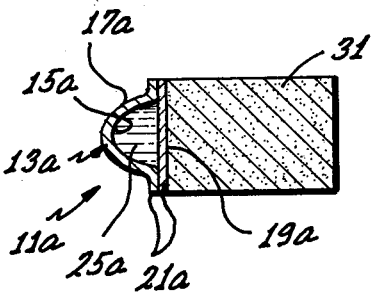
FIG. 4 is a longitudinal sectional view of a second form of weight capsule.

FIG. 4 shows a weight capsule **11*a* which includes a mass of weight composition 31 for added weight. The mass of weight composition 31 may be identical to the extrudable weight composition described in my U.S. Pat. No. 4,220,336 which is incorporated by reference herein. Briefly, the mass of weight composition is preferably easily manually moldable and of putty-like consistency. The putty-like consistency makes it easily extrudable or deformable into the shape of the cavity which it is placed in. High density, coupled with a readily manually moldable characteristics can be obtained by making the weight composition from a heavy particulate metal, such as powdered lead and a binder for holding the particulate metal together. The weight composition is preferably relatively adherent so that it will adhere or tend to stick to the wall of the cavity in which it is placed. The weight composition may be provided within a sheath, if desired. Although various configurations are possible, the weight composition 31 in the embodiment of FIG. 4** is cylindrical.

The weight capsule **11*a* also includes a rupturable wall 13*a* defining a sealed interior cavity 15*a* which contains the substance 25*a*. If the substance 25*a* is a solvent it may be, for example, acetone or hexane, which would temporarily soften or tackify the mass of weight composition 31 and then evaporate after use. The wall 13*a* comprises a nose cone shaped sheet 17*a* of lead foil and a planar sheet 19*a* of lead foil having their edges 21*a* heat sealed together to render the cavity 15*a* completely sealed. The resulting shape of the weight capsule 11*a*** is bullet-like although this is merely illustrative of the configurations which may be assumed.

In the form shown in FIG. 4, the sheet **19*a* is adhered to the mass 31 by the inherent adherent quality of the mass. Alternatively, the weight capsule 11*a* may comprise two separate pieces, i.e., the rupturable wall 15*a* and the substance 25*a* as one component and the mass 31** as the second component.

Figure 5:
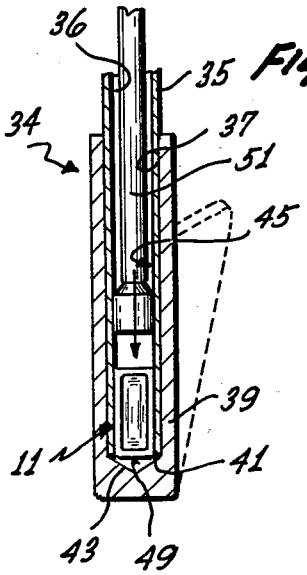
FIG. 5 is a fragmentary sectional view showing the weight capsule of FIG. 1 positioned in a golf club.

The weight capsules 11 and **11*a* can be used to weight various different members. For example, the weight capsules 11 and 11*a* can be used to weight golf clubs as shown in FIGS. 5–6 and 7–8, respectively. In this regard, FIG. 5 shows a golf club 34 which comprises a tubular shaft or shank 35 defining an axial passage 36 extending completely through the shaft. The lower end of the shaft 35 is received within a bore 37 of a head 39 of the golf club with a lower end face 41 of the shaft being closely adjacent an end wall 43 of the bore 37. The shaft 35 is suitably attached to the head 39** as by an adhesive.

With this construction the end wall 43, a lower portion 45 of the shaft 35, the end face 41 and, a portion of the peripheral surface of the bore 37 define a cavity 49 within the club 34. The end face 41 forms an annular shoulder in the cavity 49.

In weighting the article 39, it is desirable to place the required amount of weight as low down in the cavity 49 as possible. This can be accomplished with the weight capsule 11 of FIGS. 1–4.

Figure 6:
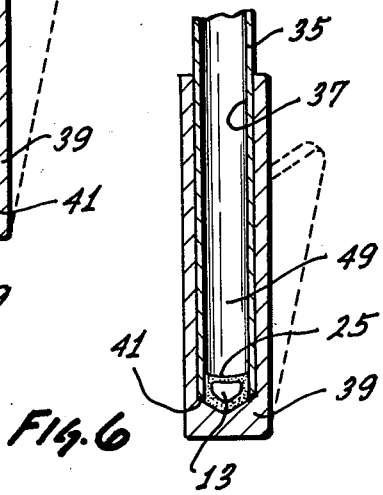
FIG. 6 is a view similar to FIG. 5 showing the fractured weight capsule in the golf club.

To weight the club 34 with the weight capsule 11 of FIGS. 1–3, a weight capsule 11 having the desired weight is placed into the passage 36 of the shaft 35 at its upper end and allowed to fall by gravity into the cavity 49. A ram 51 is then extended into the shaft 35 as shown in FIG. 5 to axially compressively load the weight capsule 11. The compressive loading is sufficient to rupture the frangible wall 13 of the weight capsule, or cause the wall 23 to break at the scoreline 23. This causes the substance 25 contained within the cavity 15 to completely fill the bottom portion of the cavity 49, as best seen in FIG. 6 and to contact the ruptured wall 13 and the cavity walls. It is preferred that the ram 51 should be made of a material that does not stick to, or react with the substance 25. This will ensure that when the ram 51 is withdrawn, it does not withdraw small amounts of the substance 25.

If the substance 25 is an adhesive, it will firmly bond the deformed wall 13 into the lower portion of the cavity 49. The adhesive would also extend under the end face 41 and interlock therewith.

If the substance 25 is a solvent, then this method efficiently localizes the effect of the solvent. The solvent will clean or prime the walls of the cavity 49 which it contacts and/or temporarily tackify the mass of weight composition on contact so that a second weight capsule containing adhesive or a weight capsule as shown in my U.S. Pat. No. 4,220,336 can then be securely held in the cavity. In any event, the solvent assures better contact between the next inserted weight capsule and the surfaces defining the walls of the cavity 49.

Figure 7:
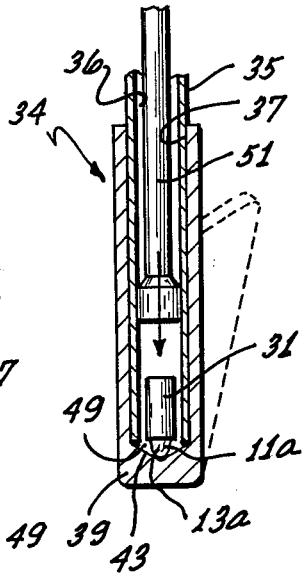
FIG. 7 shows the weight capsule of FIG. 4 positioned in a golf shaft.

In use of the weight capsule **11*a*, the capsule is dropped through the passage 36 of the shaft 35 in the same manner as described above for the weight capsule 11. As shown in FIG. 7, with the weight capsule 11***a* in the cavity 49, the rupturable wall 13*a* lies between the end wall 43 and the mass 31 of weight composition.

By axially compressing the weight capsule 11*a* with the ram 51, the frangible wall 13 ruptures and the substance 25*a* escapes into the cavity 49. This deforms the wall 13*a* and, in addition, the axial compressive force of the ram 51 on the mass 31 extrudes the mass 31 radially outwardly into tight contact with the surrounding surfaces of the cavity.

Figure 8:
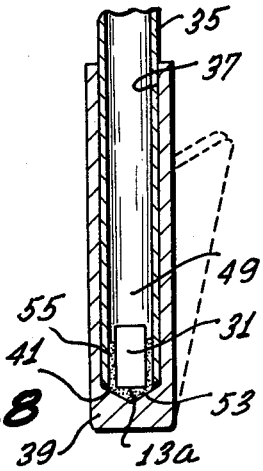
FIG. 8 is a view similar to FIG. 7 showing the fractured weight capsule of FIG. 4 in the golf club.

If the substance 25 is an adhesive, it flows into the surrounding crevices, and upon curing, causes secure bonding of the mass 31 of weight composition and the rupturable wall 13*a*. In addition, depending upon the viscosity of the adhesive and the ease with which the mass 31 can be deformed, some of the adhesive will flow upwardly between the mass 31 and the wall of the shaft 35 to form an adhesive bond 55 as shown in FIG. 8. Also, the adhesive and/or the weight composition 31 will flow beneath the end face 41 to form an interlock. If the substance 25 is a solvent, it cleans or primes the surfaces which are contacted by the mass 31, penetrates the contaminants or tackifies the mass of weight compostiion so that the inherent adherent nature of this mass can better bond to such surfaces.

Although exemplary embodiments of the invention have been shown and described, many changes, modifications and substitutions may be made by one having ordinary skill in the art without necessarily departing from the spirit and scope of this invention. It should be undertood that the invention is not to be limited to the particular embodiment described herein, but is to be limited only by the attached claims and the full range of equivalency that each element thereof is entitled to.

I claim:

1. A method of weighting an article comprising:

providing a member having an internal wall defining a cavity;

providing a weight capsule including a rupturable wall defining a sealed interior chamber and a liquid within said chamber selected from the group consisting of adhesives and solvents;

placing the weight capsule in the cavity; and rupturing said wall to free said liquid so that said liquid can come into intimate contact with the internal wall of the member.

2. A method as defined in claim 1 wherein said article is a golf club and said member includes a head having at least a portion of said cavity and a tubular shaft coupled to said head with the tubular shaft communicating with said cavity.

3. A method as defined in claim 2 including inserting a ram into said tubular shaft and carrying out said step of rupturing with said ram.

4. A method as defined in claim 1 or 3 wherein said substance is an adhesive and including curing said adhesive to adhere the ruptured wall in said cavity.

5. A method as defined in claim 1 including placing a mass of deformable weight composition in said cavity and including compressively loading said weight composition to deform the weight composition, said weight composition contacting the liquid freed from said chamber.

6. A method as defined in claim 5 wherein said liquid is a solvent which can tackify the weight composition and tackifying the weight composition with the solvent in the cavity.

7. A method as defined in claim 1 wherein the weight capsule includes a mass of deformable weight composition, said internal wall includes an end wall portion, said liquid includes an adhesive and said step of placing includes placing the rupturable wall in the cavity between the end wall portion and said mass of weight composition, said step of rupturing includes compressively loading the weight composition to deform the weight composition, and said weight composition contacting the adhesive freed from said chamber whereby the adhesive at least assists in retaining the weight capsule in the cavity.

8. The method of claim 7 wherein the member has an end face which defines a shoulder in said cavity and said step of compressively loading includes deforming the mass of weight composition into contact with said shoulder to assist in retaining the weight capsule in said cavity.

9. A method as defined in claim 1 wherein the liquid is a solvent.

* * * * *

UNITED STATES PATENT OFFICE

CERTIFICATE OF CORRECTION

Patent No. 4,452,456 Dated June 5, 1984

Inventor(s) Rudolph J. Kochevar

It is certified that error appears in the above-identified patent and that said Letters Patent are hereby corrected as shown below:

Column 1, line 10 change "include" to -- includes --.

Column 1, line 36 change "had" to -- has --.

Column 1, line 60 change "compression" to -- compressive --.

Column 3, line 31 before "silicone" insert -- a --.

Column 3, line 38 before "50%" insert -- least --.

Column 5, lines 24 and 25 change "compostiion" to -- composition --.

Signed and Sealed this

*Twelfth* Day of *February 1985*

[SEAL]

*Attest:*

DONALD J. QUIGG

*Attesting Officer* *Acting Commissioner of Patents and Trademarks*